US011365914B2

(12) United States Patent
Tanaka

(10) Patent No.: US 11,365,914 B2
(45) Date of Patent: Jun. 21, 2022

(54) REFRIGERATION CYCLE APPARATUS

(71) Applicant: Mitsubishi Electric Corporation, Tokyo (JP)

(72) Inventor: Chitose Tanaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/980,912

(22) PCT Filed: May 11, 2018

(86) PCT No.: PCT/JP2018/018341
§ 371 (c)(1),
(2) Date: Sep. 15, 2020

(87) PCT Pub. No.: WO2019/215916
PCT Pub. Date: Nov. 14, 2019

(65) Prior Publication Data

US 2021/0063033 A1 Mar. 4, 2021

(51) Int. Cl.
*F24F 5/00* (2006.01)
*F25B 41/20* (2021.01)
(Continued)

(52) U.S. Cl.
CPC ..... *F25B 41/24* (2021.01); *F24F 5/00* (2013.01); *F25B 5/02* (2013.01); *F25B 6/02* (2013.01);
(Continued)

(58) Field of Classification Search
CPC ..... F25B 41/20; F25B 41/24; F25B 41/28; F25B 41/26; F25B 5/02; F25B 6/02; F25B 13/00; F25B 2313/009
See application file for complete search history.

(56) References Cited

U.S. PATENT DOCUMENTS 5,156,014 A 10/1992 Nakamura et al.
5,237,833 A 8/1993 Hayashida et al.
(Continued)

FOREIGN PATENT DOCUMENTS

EP 2341296 A1 7/2011
EP 2378215 A1 10/2011
(Continued)

OTHER PUBLICATIONS

Extended European Search Report dated Mar. 19, 2021, issued in corresponding European Patent Application No. 18918085.4.
(Continued)

*Primary Examiner* — Miguel A Diaz
(74) *Attorney, Agent, or Firm* — Posz Law Group, PLC

(57) ABSTRACT

A refrigeration cycle apparatus includes: an outdoor unit; a branch unit connected to the outdoor unit via a first pipe and a second pipe; a first indoor unit connected to the branch unit via a third pipe and a fourth pipe; and a second indoor unit connected to the branch unit via a fifth pipe and a sixth pipe. A refrigerant circuit includes a compressor, a first heat exchanger, a second heat exchanger, a third heat exchanger, and a six-way valve. The six-way valve switches between a first state in which the first heat exchanger acts as a condenser and at least the second heat exchanger acts as an evaporator and a second state in which the first heat exchanger acts as an evaporator and at least the second heat exchanger acts as a condenser.

12 Claims, 8 Drawing Sheets

(51) Int. Cl.

| | |
|---|---|
| ***F25B 5/02*** | (2006.01) |
| ***F25B 13/00*** | (2006.01) |
| ***F25B 41/24*** | (2021.01) |
| ***F25B 6/02*** | (2006.01) |

(52) U.S. Cl.
CPC ..... *F25B 13/00* (2013.01); *F25B 41/20* (2021.01); *F25B 2313/009* (2013.01)

(56) References Cited

U.S. PATENT DOCUMENTS

| | | | | |
|---|---|---|---|---|
| 5,309,733 | A | 5/1994 | Hayashida et al. | |
| 5,388,422 | A | 2/1995 | Hayashida et al. | |
| 5,634,352 | A * | 6/1997 | Nagai | F25B 41/26 62/324.6 |
| 8,047,011 | B2 * | 11/2011 | Kawano | F25B 49/02 62/160 |
| 10,018,382 | B2 * | 7/2018 | Song | F25B 41/26 |
| 10,253,992 | B2 * | 4/2019 | Song | F25B 41/20 |
| 10,837,680 | B2 * | 11/2020 | Nishiyama | F25B 41/40 |
| 10,845,099 | B2 * | 11/2020 | Nishiyama | F25B 39/028 |
| 2011/0088421 | A1 | 4/2011 | Wakamoto et al. | |
| 2011/0146339 | A1 | 6/2011 | Yamashita et al. | |
| 2015/0253020 | A1 | 9/2015 | Honda et al. | |
| 2017/0138488 | A1 * | 5/2017 | Song | F16K 31/124 |
| 2017/0299233 | A1 | 10/2017 | Song | |
| 2019/0024951 | A1 * | 1/2019 | Nishiyama | F25B 39/028 |
| 2019/0383526 | A1 * | 12/2019 | Nishiyama | F25B 13/00 |
| 2020/0318875 | A1 * | 10/2020 | Yamada | F25B 49/02 |

FOREIGN PATENT DOCUMENTS

| | | | |
|---|---|---|---|
| EP | 3379176 | A1 | 9/2018 |
| EP | 3517853 | A1 | 7/2019 |
| JP | H04-006361 | A | 1/1992 |
| JP | 08170864 | A * | 7/1996 |
| JP | H08-170864 | A | 7/1996 |
| JP | H08-291951 | A | 11/1996 |
| WO | 2009/133640 | A1 | 11/2009 |
| WO | 2010/050003 | A1 | 5/2010 |
| WO | 2014/057550 | A1 | 4/2014 |
| WO | 2014/103407 | A1 | 7/2014 |
| WO | 2017/085888 | A1 | 5/2017 |
| WO | 2018/055741 | A1 | 3/2018 |

OTHER PUBLICATIONS

International Search Report of the International Searching Authority dated Jul. 31, 2018 for the corresponding International application No. PCT/JP2018/018341 (and English translation).

Office Action dated Nov. 16, 2021 issued in corresponding JP patent application No. 2020-517739 (and English translation).

* cited by examiner

REFRIGERATION CYCLE APPARATUS

CROSS REFERENCE TO RELATED APPLICATION

This application is a U.S. national stage application of International Application PCT/JP2018/018341 filed on May 11, 2018, the contents of which are incorporated herein by reference.

TECHNICAL FIELD

The present invention relates to a refrigeration cycle apparatus, and particularly to a refrigeration cycle apparatus including an outdoor unit, a plurality of indoor units and a branch unit.

BACKGROUND

There has been conventionally known a refrigeration cycle apparatus including an outdoor unit, a plurality of indoor units and a branch unit, wherein the outdoor unit and the plurality of indoor units are connected via the branch unit.

Japanese Patent Laying-Open No. 4-6361 discloses the above-described refrigeration cycle apparatus, wherein the outdoor unit and the branch unit are connected via a first refrigerant pipe and a second refrigerant pipe. The refrigeration cycle apparatus includes a first refrigerant flow path switching mechanism disposed in the outdoor unit, and a second refrigerant flow path switching mechanism disposed in the branch unit.

The first flow path switching mechanism includes one four-way valve and four check valves. By the first refrigerant flow path mechanism, switching is performed between a first operation state in which an outdoor heat exchanger acts as a condenser and a second operation state in which the outdoor heat exchanger acts as an evaporator, and a state in which a pressure of refrigerant flowing through the first refrigerant pipe is lower than a pressure of refrigerant flowing through the second refrigerant pipe is maintained regardless of switching between the first operation state and the second operation state. The first refrigerant pipe and the second refrigerant pipe are provided such that an inner diameter of the first refrigerant pipe is larger than an inner diameter of the second refrigerant pipe. As a result, in the above-described refrigeration cycle apparatus, an increase in pressure loss in the first refrigerant pipe and the second refrigerant pipe caused by switching between the first operation state and the second operation state is suppressed, and thus, a reduction in operation capacity is suppressed.

The second flow path switching mechanism includes a plurality of flow path switching valves. By the second refrigerant flow path mechanism, in the above-described first operation state or the above-described second operation state, switching is performed between a cooling-only operation state or a heating-only operation state in which all of the plurality of indoor units act as evaporators or condensers and a cooling-dominated operation state or a heating-dominated operation state in which one part of the plurality of indoor units act as condensers and the other part of the plurality of indoor units act as evaporators.

PATENT LITERATURE

PTL 1: Japanese Patent Laying-Open No. 4-6361

However, the above-described refrigeration cycle apparatus includes four check valves and one four-way valve, and thus, the number of components is large and the manufacturing cost is relatively high. Therefore, a reduction in manufacturing cost of the above-described refrigeration cycle apparatus is required.

In addition, in the above-described refrigeration cycle apparatus, the refrigerant flows through two of the check valves and two flow paths in the four-way valve in any of the operation states. Therefore, a pressure loss produced when the refrigerant flows through two of the check valves and two flow paths in the four-way valve is relatively high. Particularly when the above-described refrigeration cycle apparatus is in the cooling-only operation state or the cooling-dominated operation state, the gas single-phase refrigerant flowing out of an indoor heat exchanger that acts as an evaporator flows through one of the check valves and one flow path in the four-way valve and reaches a suction port of a compressor. Therefore, a so-called suction pressure loss is relatively high.

If a diameter of each check valve is increased in order to reduce such a pressure loss of the refrigerant, the manufacturing cost of the refrigeration cycle apparatus increases.

SUMMARY

A main object of the present invention is to provide a refrigeration cycle apparatus with reduced manufacturing cost and reduced pressure loss as compared with the above-described conventional refrigeration cycle apparatus.

A refrigeration cycle apparatus according to the present invention includes: an outdoor unit; a branch unit connected to the outdoor unit via a first pipe and a second pipe; a first indoor unit connected to the branch unit via a third pipe and a fourth pipe; and a second indoor unit connected to the branch unit via a fifth pipe and a sixth pipe. A refrigerant circuit includes a compressor, a first heat exchanger, a second heat exchanger, a third heat exchanger, and a six-way valve. The compressor, the first heat exchanger and the six-way valve are located in the outdoor unit. The second heat exchanger is disposed in the branch unit or the first indoor unit. The third heat exchanger is disposed in the branch unit or the second indoor unit. The first heat exchanger has a first flow port and a second flow port through which the refrigerant flows in and out in the refrigerant circuit. The six-way valve switches between a first state in which the first heat exchanger acts as a condenser and at least the second heat exchanger acts as an evaporator and a second state in which the first heat exchanger acts as an evaporator and at least the second heat exchanger acts as a condenser. In the first state, the six-way valve has a first flow path connecting a discharge port of the compressor to the first flow port of the first heat exchanger, a second flow path connecting the second flow port of the first heat exchanger to the second pipe, and a third flow path connecting the first pipe to a suction port of the compressor. In the second state, the six-way valve has a fourth flow path connecting the discharge port of the compressor to the second pipe, a fifth flow path connecting the first pipe to the second flow port of the first heat exchanger, and a sixth flow path connecting the first flow port of the first heat exchanger to the suction port of the compressor.

The refrigeration cycle apparatus according to the present invention includes the six-way valve, and thus, switching between the two states, which is implemented by one four-way valve and four check valves in the refrigeration cycle apparatus described in PTL 1 above, can be implemented by one six-way valve. Therefore, according to the present invention, there can be provided a refrigeration cycle apparatus that simultaneously achieves a reduction in manufacturing cost and a further reduction in pressure loss as compared with the above-described refrigeration cycle apparatus.

DETAILED DESCRIPTION

Figure 1:
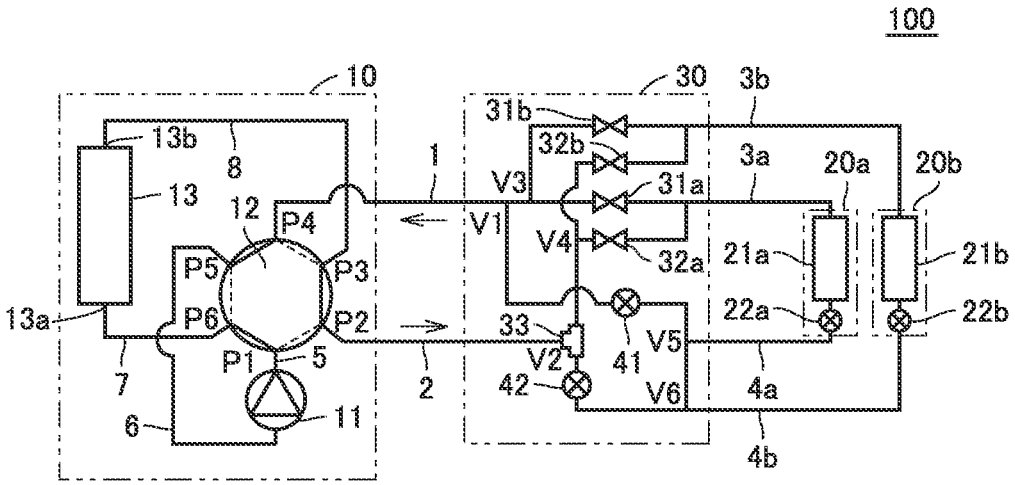
FIG. 1 shows a refrigeration cycle apparatus according to a first embodiment.

Embodiments of the present invention will be described in detail hereinafter with reference to the drawings, in which the same or corresponding portions are designated by the same reference characters and description thereof will not be repeated in principle.

First Embodiment

As shown in FIG. 1, a refrigeration cycle apparatus 100 according to a first embodiment includes a refrigerant circuit in which refrigerant circulates. The refrigerant circuit includes a compressor 11, a six-way valve 12, a first outdoor heat exchanger 13 as a first heat exchanger, a first indoor heat exchanger 21*a* as a second heat exchanger, a second indoor heat exchanger 21*b* as a third heat exchanger, a first decompressing unit 22*a*, a second decompressing unit 22*b*, a plurality of on-off valves 31*a*, 31*b*, 32*a*, and 32*b*, a third decompressing unit 41, and a fourth decompressing unit 42. The refrigerant is not particularly limited.

From a different perspective, refrigeration cycle apparatus 100 includes an outdoor unit 10, a first indoor unit 20*a*, a second indoor unit 20*b*, and a branch unit 30. A first circuit portion of the above-described refrigerant circuit including compressor 11, six-way valve 12 and first outdoor heat exchanger 13 is disposed in outdoor unit 10. A second circuit portion of the above-described refrigerant circuit including first indoor heat exchanger 21*a* and first decompressing unit 22*a* is disposed in first indoor unit 20*a*. A third circuit portion of the above-described refrigerant circuit including second indoor heat exchanger 21*b* and second decompressing unit 22*b* is disposed in second indoor unit 20*b*. A fourth circuit portion of the above-described refrigerant circuit including the plurality of on-off valves 31*a*, 31*b*, 32*a*, and 32*b*, third decompressing unit 41 and fourth decompressing unit 42 is disposed in branch unit 30.

The above-described first circuit portion of the above-described refrigerant circuit disposed in outdoor unit 10 and the above-described fourth circuit portion of the above-described refrigerant circuit disposed in branch unit 30 are connected via a first pipe 1 and a second pipe 2. The above-described fourth circuit portion of the above-described refrigerant circuit disposed in branch unit 30 and the above-described second circuit portion of the above-described refrigerant circuit disposed in first indoor unit 20*a* are connected via a third pipe 3*a* and a fourth pipe 4*a*. The above-described fourth circuit portion of the above-described refrigerant circuit disposed in branch unit 30 and the above-described third circuit portion of the above-described refrigerant circuit disposed in second indoor unit 20*b* are connected via a fifth pipe 3*b* and a sixth pipe 4*b*. The above-described second circuit portion and the above-described third circuit portion of the above-described refrigerant circuit are connected in parallel with the above-described fourth circuit portion.

Compressor 11 has a discharge port through which the refrigerant is discharged, and a suction port through which the refrigerant is sucked. The discharge port of compressor 11 is connected to a discharge pipe 5. The suction port of compressor 11 is connected to a suction pipe 6. Compressor 11 is implemented by, for example, an inverter compressor in which inverter control of the number of rotations is performed.

First outdoor heat exchanger 13 has a first flow port 13*a* and a second flow port 13*b* through which the refrigerant flows in and out. First flow port 13*a* is connected to a first flow pipe 7, and second flow port 13*b* is connected to a second flow pipe 8.

Six-way valve 12 switches between a first state in which first outdoor heat exchanger 13 acts as a condenser and at least first indoor heat exchanger 21*a* acts as an evaporator and a second state in which first outdoor heat exchanger 13 acts as an evaporator and at least first indoor heat exchanger 21*a* acts as a condenser.

Six-way valve 12 has a first opening P1, a second opening P2, a third opening P3, a fourth opening P4, a fifth opening P5, and a sixth opening P6. First opening P1 is connected to the discharge port of compressor 11 via discharge pipe 5. Second opening P2 is connected to second pipe 2. Third opening P3 is connected to second flow port 13*b* of first outdoor heat exchanger 13 via second flow pipe 8. Fourth opening P4 is connected to first pipe 1. Fifth opening P5 is connected to the suction port of compressor 11 via suction pipe 6. Sixth opening P6 is connected to first flow port 13*a* of first outdoor heat exchanger 13 via first flow pipe 7.

In the first state, a first flow path connecting the discharge port of compressor 11 to first flow port 13*a* of first outdoor heat exchanger 13, a second flow path connecting second flow port 13*b* of first outdoor heat exchanger 13 to second pipe 2, and a third flow path connecting first pipe 1 to the suction port of compressor 11 are disposed in six-way valve 12.

In the second state, a fourth flow path connecting the discharge port of compressor 11 to second pipe 2, a fifth flow path connecting first pipe 1 to second flow port 13*b* of first outdoor heat exchanger 13, and a sixth flow path connecting first flow port 13*a* of first outdoor heat exchanger 13 to the suction port of compressor 11 are disposed in six-way valve 12.

First indoor heat exchanger 21*a* is connected in series to first decompressing unit 22*a*. First indoor heat exchanger 21*a* has two flow ports through which the refrigerant flows in and out. One flow port of first indoor heat exchanger 21*a* is connected to third pipe 3*a*. The other flow port of first indoor heat exchanger 21*a* is connected to fourth pipe 4*a* via first decompressing unit 22*a*.

Second indoor heat exchanger 21*b* is connected in series to second decompressing unit 22*b*. Second indoor heat exchanger 21*b* has two flow ports through which the refrigerant flows in and out. One flow port of second indoor heat exchanger 21*b* is connected to fifth pipe 3*b*. The other flow port of second indoor heat exchanger 21*b* is connected to sixth pipe 4*b* via second decompressing unit 22*b*.

The above-described fourth circuit portion of the above-described refrigerant circuit disposed in branch unit 30 further has a first connection pipe that connects third pipe 3*a* and fifth pipe 3*b* in parallel with first pipe 1, a second connection pipe that connects third pipe 3*a* and fifth pipe 3*b* in parallel with second pipe 2, a third connection pipe that connects fourth pipe 4*a* and sixth pipe 4*b* in parallel with first pipe 1, and a fourth connection pipe that connects fourth pipe 4*a* and sixth pipe 4*b* in parallel with second pipe 2.

The third connection pipe is a pipe that branches off from the first connection pipe. The first connection pipe and the third connection pipe have a first branch portion V1, and share a portion located on the first pipe 1 side relative to first branch portion V1. The fourth connection pipe is a pipe that branches off from the second connection pipe. The second connection pipe and the fourth connection pipe have a second branch portion V2, and share a portion located on the second pipe 2 side relative to second branch portion V2.

On-off valve 31*a* is disposed on the third pipe 3*a* side relative to a third branch portion V3 included in the above-described first connection pipe. On-off valve 31*a* is disposed between first pipe 1 and third pipe 3*a*. On-off valve 31*a* opens and closes a pipe of the above-described first connection pipe that connects first pipe 1 and third pipe 3*a*.

On-off valve 31*b* is disposed on the fifth pipe 3*b* side relative to third branch portion V3 included in the above-described first connection pipe. On-off valve 31*b* is disposed between first pipe 1 and fifth pipe 3*b*. On-off valve 31*b* opens and closes a pipe of the above-described first connection pipe that connects first pipe 1 and fifth pipe 3*b*.

On-off valve 32*a* is disposed on the third pipe 3*a* side relative to a fourth branch portion V4 included in the above-described second connection pipe. On-off valve 32*a* is disposed between second pipe 2 and third pipe 3*a*. On-off valve 32*a* opens and closes a pipe of the above-described second connection pipe that connects second pipe 2 and third pipe 3*a*.

On-off valve 32*b* is disposed on the fifth pipe 3*b* side relative to fourth branch portion V4 included in the above-described second connection pipe. On-off valve 32*b* is disposed between second pipe 2 and fifth pipe 3*b*. On-off valve 32*b* opens and closes a pipe of the above-described second connection pipe that connects second pipe 2 and fifth pipe 3*b*. The plurality of on-off valves 31*a*, 31*b*, 32*a*, and 32*b* may be configured arbitrarily as long as they can control the opening and closing operation, and may be solenoid valves, for example.

Third decompressing unit 41 is disposed on the first pipe 1 side relative to a fifth branch portion V5 included in the above-described third connection pipe. Third decompressing unit 41 is disposed between first pipe 1 and fourth pipe 4*a* and between first pipe 1 and sixth pipe 4*b*. Third decompressing unit 41 opens and closes the above-described third connection pipe.

Fourth decompressing unit 42 is disposed on the second pipe 2 side relative to a sixth branch portion V6 included in the above-described fourth connection pipe. Fourth decompressing unit 42 is disposed between second pipe 2 and fourth pipe 4*a* and between second pipe 2 and sixth pipe 4*b*. Fourth decompressing unit 42 opens and closes the above-described fourth connection pipe.

Second branch portion V2 of the above-described second connection pipe and the above-described fourth connection pipe is implemented by a branch pipe 33. Branch pipe 33 has a flow port connected to second pipe 2, a flow port included in the second connection pipe, and a flow port included in the fourth connection pipe. In branch pipe 33, the flow port included in the second connection pipe is disposed above the flow port included in the fourth connection pipe.

<Operation of Refrigeration Cycle Apparatus>

As described above, six-way valve 12 switches between the above-described first state and the above-described second state. Furthermore, when refrigeration cycle apparatus 100 is in the above-described first state, branch unit 30 switches between a third state shown in FIG. 2 and a fourth state shown in FIG. 3. Furthermore, when refrigeration cycle apparatus 100 is in the above-described second state, branch unit 30 switches between a fifth state shown in FIG. 4 and a sixth state shown in FIG. 5.

Figure 2:
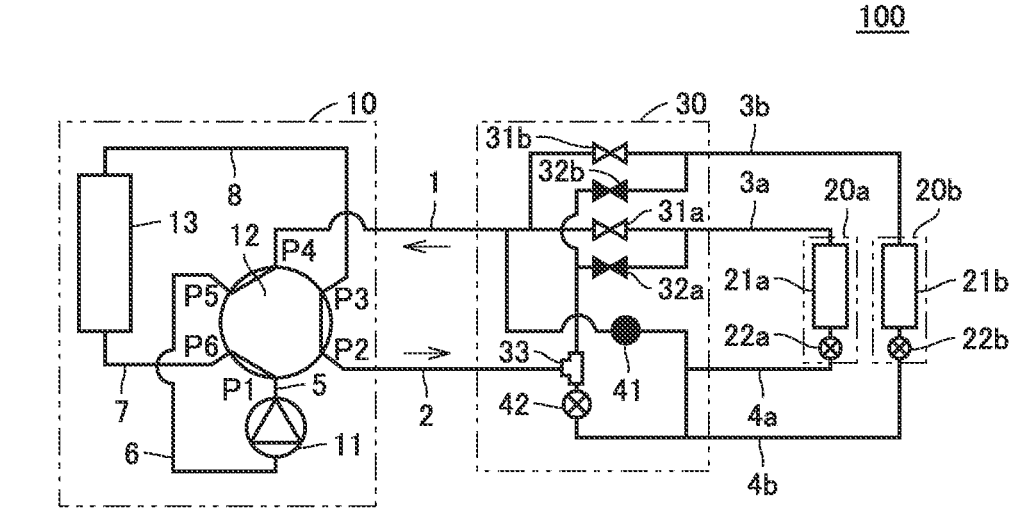
FIG. 2 shows a refrigerant circuit when the refrigeration cycle apparatus shown in FIG. 1 is performing a cooling-only operation.
Figure 3:
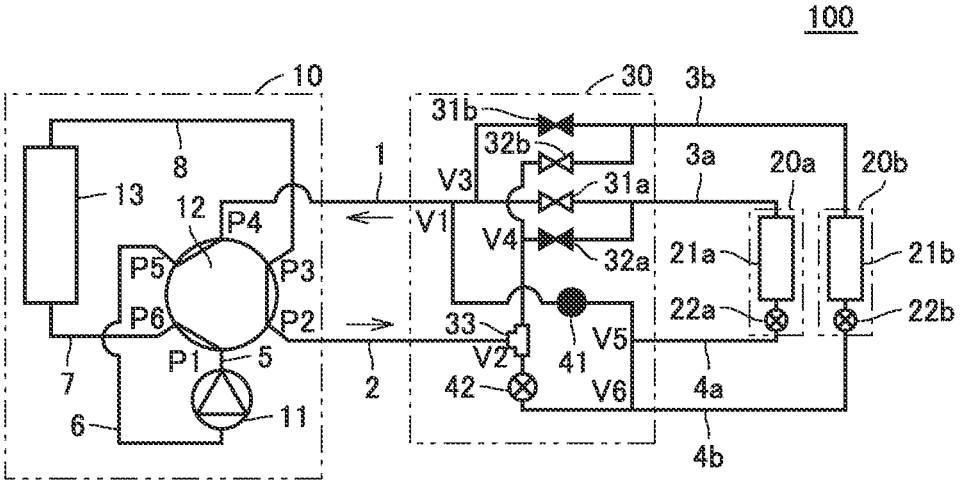
FIG. 3 shows a refrigerant circuit when the refrigeration cycle apparatus shown in FIG. 1 is performing a cooling-dominated operation.

As shown in FIG. 2, in the above-described third state, all of the indoor units perform a cooling operation. That is, the above-described third state is implemented during a cooling-only operation. As shown in FIG. 3, in the above-described fourth state, first indoor unit 20*a* performs the cooling operation and second indoor unit 20*b* performs a heating operation, and a cooling air-conditioning load is larger than a heating air-conditioning load. That is, the above-described fourth state is implemented during a cooling-dominated operation. In other words, the above-described first state is implemented by six-way valve 12 when refrigeration cycle apparatus 100 performs the cooling-only operation and the cooling-dominated operation.

Figure 4:
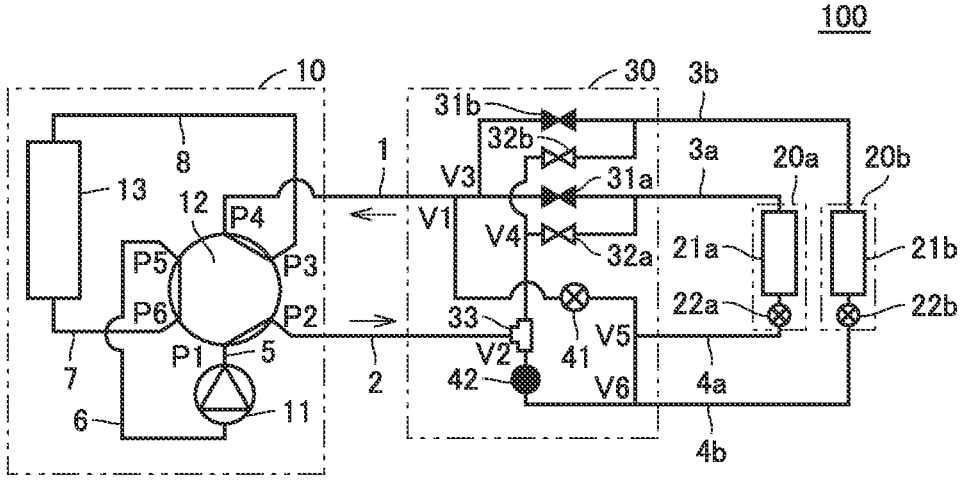
FIG. 4 shows a refrigerant circuit when the refrigeration cycle apparatus shown in FIG. 1 is performing a heating-only operation.
Figure 5:
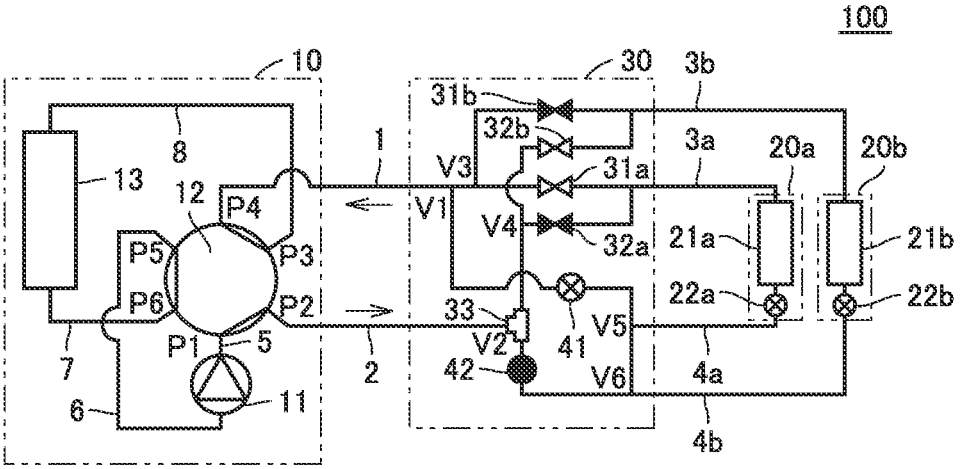
FIG. 5 shows a refrigerant circuit when the refrigeration cycle apparatus shown in FIG. 1 is performing a heating-dominated operation.

As shown in FIG. 4, in the above-described fifth state, all of the indoor units perform the heating operation. That is, the above-described fifth state is implemented during a heating-only operation. As shown in FIG. 5, in the above-described sixth state, first indoor unit 20*a* performs the cooling operation and second indoor unit 20*b* performs the heating operation, and the heating air-conditioning load is larger than the cooling air-conditioning load. That is, the above-described sixth state is implemented during a heating-dominated operation. In other words, the above-described second state is implemented by six-way valve 12 when refrigeration cycle apparatus 100 performs the heating-only operation and the heating-dominated operation.

<Cooling-Only Operation>

As shown in FIG. 2, during the cooling-only operation, the above-described first state is implemented by six-way valve 12 and the above-described third state is implemented by branch unit 30. During the cooling-only operation, on-off valves 31*a* and 31*b* of branch unit 30 and fourth decompressing unit 42 are opened and on-off valves 32*a* and 32*b* of branch unit 30 and third decompressing unit 41 are closed. As a result, when refrigeration cycle apparatus 100 is in the above-described third state, a refrigerant flow path described below is formed in the above-described refrigerant circuit.

The gas single-phase refrigerant discharged from compressor 11 flows through discharge pipe 5, the above-described first flow path of six-way valve 12, and first flow pipe 7, and flows into first outdoor heat exchanger 13 through first flow port 13*a*. The gas single-phase refrigerant flowing into first outdoor heat exchanger 13 is subjected to heat exchange with the outdoor air, to thereby condense to liquid single-phase refrigerant. The liquid single-phase refrigerant flowing out through second flow port 13*b* of first outdoor heat exchanger 13 flows through the above-described second flow path of six-way valve 12 and second pipe 2 into branch unit 30.

The liquid single-phase refrigerant flowing into branch unit 30 flows through fourth decompressing unit 42, and then, is divided in sixth branch portion V6 into a part of the liquid single-phase refrigerant to be supplied to first indoor unit 20*a* and a remaining part to be supplied to second indoor unit 20*b*. The part of the liquid single-phase refrigerant flows through fourth pipe 4*a* into first indoor unit 20*a* and is decompressed and expanded to gas-liquid two-phase refrigerant in first decompressing unit 22*a*. The remaining part of the liquid single-phase refrigerant flows through sixth pipe 4*b* into second decompressing unit 22*b* and is decompressed and expanded to gas-liquid two-phase refrigerant in second decompressing unit 22*b*.

The gas-liquid two-phase refrigerant flowing into each of first indoor heat exchanger 21*a* and second indoor heat exchanger 21*b* is subjected to heat exchange with the indoor air, to thereby evaporate to gas single-phase refrigerant. The gas single-phase refrigerant flowing out of first indoor heat exchanger 21*a* flows through third pipe 3*a* and on-off valve 31*a* to third branch portion V3. The gas single-phase refrigerant flowing out of second indoor heat exchanger 21*b* flows through fifth pipe 3*b* and on-off valve 31*b* to third branch portion V3. The gas single-phase refrigerant flowing out of first indoor heat exchanger 21*a* and the gas single-phase refrigerant flowing out of second indoor heat exchanger 21*b* join in third branch portion V3 and flow through first pipe 1 into outdoor unit 10. A pressure of the gas single-phase refrigerant flowing through first pipe 1 is lower than a pressure of the liquid single-phase refrigerant flowing through second pipe 2.

The gas single-phase refrigerant flowing into outdoor unit 10 flows through the above-described third flow path of six-way valve 12 and suction pipe 6 and is sucked into the suction port of compressor 11. The gas single-phase refrigerant is compressed by compressor 11, and then, is again discharged from the discharge port.

<Cooling-Dominated Operation>

As shown in FIG. 3, during the cooling-dominated operation, the above-described first state is implemented by six-way valve 12 and the above-described fourth state is implemented by branch unit 30. During the cooling-dominated operation, on-off valves 31*a* and 32*b* of branch unit 30 are opened and on-off valves 31*b* and 32*a* of branch unit 30 and third decompressing unit 41 are closed. A degree of opening of fourth decompressing unit 42 is adjusted as appropriate in accordance with a difference between the cooling air-conditioning load and the heating air-conditioning load. As a result, when refrigeration cycle apparatus 100 is in the above-described fourth state, a refrigerant flow path described below is formed in the above-described refrigerant circuit.

The gas single-phase refrigerant discharged from compressor 11 flows through discharge pipe 5, the above-described first flow path of six-way valve 12, and first flow pipe 7, and flows into first outdoor heat exchanger 13 through first flow port 13*a*. The gas single-phase refrigerant flowing into first outdoor heat exchanger 13 is subjected to heat exchange with the outdoor air, to thereby condense to gas-liquid two-phase refrigerant. The gas-liquid two-phase refrigerant flowing out through second flow port 13*b* of first outdoor heat exchanger 13 flows through the above-described second flow path of six-way valve 12 and second pipe 2 into branch unit 30.

The gas-liquid two-phase refrigerant flowing into branch unit 30 is divided by branch pipe 33 disposed in second branch portion V2 into gas single-phase refrigerant flowing through the above-described second connection pipe and liquid single-phase refrigerant flowing through the above-described fourth connection pipe. This is because the flow port of branch pipe 33 included in the second connection pipe is disposed above the flow port of branch pipe 33 included in the fourth connection pipe as described above.

The gas single-phase refrigerant subjected to gas-liquid separation by branch pipe 33 flows through on-off valve 32*b* disposed in the above-described second connection pipe and fifth pipe 3*b* into second indoor heat exchanger 21*b* and is subjected to heat exchange with the indoor air, to thereby condense to liquid single-phase refrigerant. The liquid single-phase refrigerant flows through second decompressing unit 22*b* and sixth pipe 4*b* into branch unit 30 and reaches sixth branch portion V6. The liquid single-phase refrigerant subjected to gas-liquid separation by branch pipe 33 flows through fourth decompressing unit 42 disposed in the above-described fourth connection pipe to sixth branch portion V6, where the liquid single-phase refrigerant subjected to gas-liquid separation by branch pipe 33 joins with the liquid single-phase refrigerant flowing through sixth pipe 4*b* into sixth branch portion V6. The liquid single-phase refrigerant flows through fourth pipe 4*a* into first decompressing unit 22*a* and is decompressed and expanded to gas-liquid two-phase refrigerant in first decompressing unit 22*a*. The gas-liquid two-phase refrigerant flowing into first indoor heat exchanger 21*a* is subjected to heat exchange with the indoor air, to thereby evaporate to gas single-phase refrigerant.

The gas single-phase refrigerant flowing out of first indoor heat exchanger 21*a* flows through third pipe 3*a*, on-off valve 31*a* and first pipe 1 into outdoor unit 10. A pressure of the gas single-phase refrigerant flowing through first pipe 1 is lower than a pressure of the gas-liquid two-phase refrigerant flowing through second pipe 2.

The gas single-phase refrigerant flowing into outdoor unit 10 flows through the above-described third flow path of six-way valve 12 and suction pipe 6 and is sucked into the suction port of compressor 11. The gas single-phase refrigerant is compressed by compressor 11, and then, is again discharged from the discharge port.

<Heating-Only Operation>

As shown in FIG. 4, during the heating-only operation, the above-described second state is implemented by six-way valve 12 and the above-described fifth state is implemented by branch unit 30. During the heating-only operation, on-off valves 32*a* and 32*b* of branch unit 30 and third decompressing unit 41 are opened and on-off valves 31*a* and 31*b* of branch unit 30 and fourth decompressing unit 42 are closed.

As a result, when refrigeration cycle apparatus 100 is in the above-described fifth state, a refrigerant flow path described below is formed in the above-described refrigerant circuit.

The gas single-phase refrigerant discharged from compressor 11 flows through discharge pipe 5, the above-described fourth flow path of six-way valve 12, and second pipe 2 into branch unit 30. The gas single-phase refrigerant flowing into branch unit 30 flows through the above-described second connection pipe, and then, is divided in the fourth branch portion into a part of the gas single-phase refrigerant to be supplied to first indoor unit 20*a* and a remaining part to be supplied to second indoor unit 20*b*. The part of the gas single-phase refrigerant flows through on-off valve 32*a* and third pipe 3*a* into first indoor heat exchanger 21*a*. The remaining part of the gas single-phase refrigerant flows through on-off valve 32*b* and fifth pipe 3*b* into second indoor heat exchanger 21*b*.

The gas single-phase refrigerant flowing into each of first indoor heat exchanger 21*a* and second indoor heat exchanger 21*b* is subjected to heat exchange with the indoor air, to thereby condense to liquid single-phase refrigerant. The liquid single-phase refrigerant is decompressed and expanded to gas-liquid two-phase refrigerant in first decompressing unit 22*a* or second decompressing unit 22*b*.

The gas-liquid two-phase refrigerant flowing out of first indoor unit 20*a* flows through fourth pipe 4*a* to fifth branch portion V5. The gas-liquid two-phase refrigerant flowing out of second indoor unit 20*b* flows through sixth pipe 4*b* to fifth branch portion V5. The gas-liquid two-phase refrigerant flowing out of first indoor unit 20*a* and the gas-liquid two-phase refrigerant flowing out of second indoor unit 20*b* join in fifth branch portion V5 and flow through third decompressing unit 41 and first pipe 1 into outdoor unit 10. A pressure of the gas-liquid two-phase refrigerant flowing through first pipe 1 is lower than a pressure of the gas single-phase refrigerant flowing through second pipe 2.

The gas-liquid two-phase refrigerant flowing into outdoor unit 10 flows through the above-described fifth flow path of six-way valve 12 and second flow pipe 8, and flows into first outdoor heat exchanger 13 through second flow port 13*b*. The gas-liquid two-phase refrigerant flowing into first outdoor heat exchanger 13 is subjected to heat exchange with the outdoor air, to thereby evaporate to gas single-phase refrigerant. The gas single-phase refrigerant flowing out through first flow port 13*a* of first outdoor heat exchanger 13 flows through the above-described sixth flow path of six-way valve 12 and suction pipe 6 and is sucked into the suction port of compressor 11. The gas single-phase refrigerant is compressed by compressor 11, and then, is again discharged from the discharge port.

<Heating-Dominated Operation>

As shown in FIG. 5, during the heating-dominated operation, the above-described second state is implemented by six-way valve 12 and the above-described sixth state is implemented by branch unit 30. During the heating-dominated operation, on-off valves 31*a* and 32*b* of branch unit 30 are opened and on-off valves 32*a* and 31*b* of branch unit 30 and fourth decompressing unit 42 are closed. A degree of opening of third decompressing unit 41 is adjusted as appropriate in accordance with a difference between the cooling air-conditioning load and the heating air-conditioning load. As a result, when refrigeration cycle apparatus 100 is in the above-described sixth state, a refrigerant flow path described below is formed in the above-described refrigerant circuit.

The gas single-phase refrigerant discharged from compressor 11 flows through discharge pipe 5, the above-described fourth flow path of six-way valve 12, and second pipe 2 into branch unit 30. The gas single-phase refrigerant flowing into branch unit 30 flows through on-off valve 32*b* disposed in the above-described second connection pipe and fifth pipe 3*b* into second indoor heat exchanger 21*b* and is subjected to heat exchange with the indoor air, to thereby condense to liquid single-phase refrigerant. The liquid single-phase refrigerant flows through second decompressing unit 22*b* and sixth pipe 4*b* into branch unit 30 and reaches fifth branch portion V5.

A part of the liquid single-phase refrigerant reaching fifth branch portion V5 flows into third decompressing unit 41 and is decompressed and expanded to gas-liquid two-phase refrigerant in third decompressing unit 41.

A remaining part of the liquid single-phase refrigerant reaching fifth branch portion V5 flows through fourth pipe 4*a* into first decompressing unit 22*a* and is decompressed and expanded to gas-liquid two-phase refrigerant in first decompressing unit 22*a*. The gas-liquid two-phase refrigerant flowing into first indoor heat exchanger 21*a* is subjected to heat exchange with the indoor air, to thereby evaporate to gas single-phase refrigerant. The gas single-phase refrigerant flows through third pipe 3*a* and on-off valve 31*a* to first branch portion V1, and joins with the gas-liquid two-phase refrigerant flowing through third decompressing unit 41 into first branch portion V1. The gas-liquid two-phase refrigerant flows through first pipe 1 into outdoor unit 10. A pressure of the gas-liquid two-phase refrigerant flowing through first pipe 1 is lower than a pressure of the gas single-phase refrigerant flowing through second pipe 2.

The gas-liquid two-phase refrigerant flowing into outdoor unit 10 flows through the above-described fifth flow path of six-way valve 12 and second flow pipe 8, and flows into first outdoor heat exchanger 13 through second flow port 13*b*. The gas-liquid two-phase refrigerant flowing into first outdoor heat exchanger 13 is subjected to heat exchange with the outdoor air, to thereby evaporate to gas single-phase refrigerant. The gas single-phase refrigerant flowing out through first flow port 13*a* of first outdoor heat exchanger 13 flows through the above-described sixth flow path of six-way valve 12 and suction pipe 6 and is sucked into the suction port of compressor 11. The gas single-phase refrigerant is compressed by compressor 11, and then, is again discharged from the discharge port.

<Function and Effect>

Refrigeration cycle apparatus 100 is a refrigeration cycle apparatus having a refrigerant circuit in which refrigerant circulates. Refrigeration cycle apparatus 100 includes: outdoor unit 10; branch unit 30 connected to outdoor unit 10 via the first pipe and the second pipe; first indoor unit 20*a* connected to branch unit 30 via the third pipe and the fourth pipe; and second indoor unit 20*b* connected to branch unit 30 via the fifth pipe and the sixth pipe. The refrigerant circuit includes compressor 11, first outdoor heat exchanger 13, first indoor heat exchanger 21*a*, second indoor heat exchanger 21*b*, and six-way valve 12. Compressor 11, first outdoor heat exchanger 13 and six-way valve 12 are located in outdoor unit 10. First indoor heat exchanger 21*a* is disposed in first indoor unit 20*a*. Second indoor heat exchanger 21*b* is disposed in second indoor unit 20*b*. First outdoor heat exchanger 13 has a first flow port and a second flow port through which the refrigerant flows in and out in the refrigerant circuit Six-way valve 12 switches between the first state in which first outdoor heat exchanger 13 acts as a condenser and at least the second heat exchanger acts as an evaporator and the second state in which first outdoor heat exchanger 13 acts as an evaporator and at least the second heat exchanger acts as a condenser. In the first state, the first flow path connecting the discharge port of compressor 11 to the first flow port of first outdoor heat exchanger 13, the second flow path connecting the second flow port of first outdoor heat exchanger 13 to the second pipe, and the third flow path connecting the first pipe to the suction port of compressor 11 are disposed in six-way valve 12. In the second state, the fourth flow path connecting the discharge port of compressor 11 to the second pipe, the fifth flow path connecting the first pipe to the second flow port of first outdoor heat exchanger 13, and the sixth flow path connecting the first flow port of first outdoor heat exchanger 13 to the suction port of compressor 11 are disposed in six-way valve 12.

In the first state, branch unit 30 switches between the third state in which first indoor heat exchanger 21*a* and second indoor heat exchanger 21*b* act as evaporators and the fourth state in which first indoor heat exchanger 21*a* acts as an evaporator and second indoor heat exchanger 21*b* acts as a condenser. In the second state, branch unit 30 switches between the fifth state in which first indoor heat exchanger 21*a* and second indoor heat exchanger 21*b* act as condensers and the sixth state in which second indoor heat exchanger 21*b* acts as a condenser and first indoor heat exchanger 21*a* acts as an evaporator.

In such refrigeration cycle apparatus 100, by one six-way valve 12 and one branch unit 30, switching can be performed among the cooling-only operation, the cooling-dominated operation, the heating-only operation, and the heating-dominated operation. For example, as for an air-conditioning facility in a large building, when an operation state of an indoor unit disposed in a general room is heating, an operation state of an indoor unit disposed in a room having a large amount of heat generation, such as a computer room or a kitchen, may in some cases be cooling. Refrigeration cycle apparatus 100 described above is suitable for such an air-conditioning facility.

Furthermore, in refrigeration cycle apparatus 100, in all of the above-described operation states, the pressure of the gas-liquid two-phase refrigerant flowing through first pipe 1 is lower than the pressure of the gas single-phase refrigerant flowing through second pipe 2. In contrast, in the refrigeration cycle apparatus described in PTL 1 above, the above-described switching is implemented by one four-way valve, four check valves and one branch unit.

That is, the number of components for performing the above-described switching is smaller in refrigeration cycle apparatus 100 than in the refrigeration cycle apparatus described in PTL 1 above. As a result, the manufacturing cost of refrigeration cycle apparatus 100 can be reduced as compared with the manufacturing cost of the above-described conventional refrigeration cycle apparatus. The manufacturing cost of refrigeration cycle apparatus 100 is also reduced as compared with the manufacturing cost when the four check valves are replaced with four solenoid valves in the above-described conventional refrigeration cycle apparatus.

In addition, in the above-described conventional refrigeration cycle apparatus, the refrigerant flows through two of the check valves and two flow paths in the four-way valve in any of the operation states. A pressure loss of the refrigerant flowing through a check valve is higher than a pressure loss of the refrigerant flowing through one flow path in the four-way valve or six-way valve 12. Particularly when a diameter of the check valve is set relatively small in order to reduce the manufacturing cost thereof, the pressure loss of the refrigerant flowing through the check valve is significantly higher than the pressure loss of the refrigerant flowing through one flow path in the four-way valve or six-way valve 12. On the other hand, when the diameter of the check valve is increased in order to reduce the pressure loss of the refrigerant flowing through the check valve, the manufacturing cost of the refrigeration cycle apparatus is increased.

In contrast, in refrigeration cycle apparatus 100, the refrigerant flows through three flow paths in six-way valve 12 in any of the operation states. A sum of pressure losses of the refrigerant flowing through three flow paths in six-way valve 12 may be smaller than a sum of pressure losses of the refrigerant flowing through two of the check valves and two flow paths in the four-way valve. That is, in refrigeration cycle apparatus 100, the manufacturing cost is reduced and the pressure loss is also reduced, as compared with the above-described conventional refrigeration cycle apparatus.

Particularly, in the above-described conventional refrigeration cycle apparatus, the gas single-phase refrigerant flowing out of the indoor heat exchanger that acts as an evaporator during the cooling-only operation and during the cooling-dominated operation flows through one check valve and one flow path in the four-way valve. In contrast, in refrigeration cycle apparatus 100, the gas single-phase refrigerant flowing out of the indoor heat exchanger that acts as an evaporator during the cooling-only operation and during the cooling-dominated operation flows through the third flow path of six-way valve 12 to the suction port of compressor 11. Therefore, a suction pressure loss during the cooling-only operation and during the cooling-dominated operation is lower in refrigeration cycle apparatus 100 than in the above-described conventional refrigeration cycle apparatus.

In addition, the number of components is smaller, and thus, the number of connections between the components is smaller and the number of brazed portions on the above-described refrigerant circuit is also smaller in refrigeration cycle apparatus 100 than in the above-described conventional refrigeration cycle apparatus. As a result, the risk of the occurrence of poor connection between the brazed portions in refrigeration cycle apparatus 100 is lower than the risk of the occurrence of poor connection between the brazed portions in the above-described conventional refrigeration cycle apparatus. Furthermore, outdoor unit 10 of refrigeration cycle apparatus 100 can be reduced in size because the number of components is smaller in outdoor unit 10 of refrigeration cycle apparatus 100 than in the outdoor unit of the above-described conventional refrigeration cycle apparatus.

Particularly, the above-described check valves have limitations in terms of arrangement, whereas six-way valve 12 does not have such limitations. Therefore, the refrigerant pipes connected to six-way valve 12 in refrigeration cycle apparatus 100 can be made shorter than the refrigerant pipes connected to four check valves in the above-described conventional refrigeration cycle apparatus. As a result, outdoor unit 10 of refrigeration cycle apparatus 100 can be reduced in size, as compared with the outdoor unit of the above-described conventional refrigeration cycle apparatus.

In addition, the upward force caused by a refrigerant flow and the downward force caused by the gravity force or the elastic force of a spring are applied to a valve body of a general check valve as described above. Opening and closing of the check valve is switched in accordance with whether or not one of the two forces is greater than the other. In addition, in the case of an inverter compressor, the number of rotations of the compressor is controlled in accordance with an air-conditioning load. Therefore, when an air-conditioning load of a refrigeration cycle apparatus is small, the number of rotations of the compressor is small and a flow rate of the refrigerant decreases. Thus, in the case where the above-described conventional refrigeration cycle apparatus includes the above-described general check valve and the above-described inverter compressor, the upward force applied to the valve body of the check valve may be reduced to thereby balance with the downward force applied to the valve body, when the air-conditioning load is small. In this case, the valve body vibrates without being fixed, and periodically comes into collision with another member such as a valve chamber of the check valve. As a result, the valve body or the other member of the check valve may be scraped to thereby reduce a closing capacity of the check valve, and/or noise may occur. In contrast, switching between the above-described first state and the above-described second state by six-way valve 12 is not performed by the force applied to a valve body due to a refrigerant flow. Therefore, an abnormality that occurs in the above-described check valve does not occur in six-way valve 12, even when the air-conditioning load is small and the flow rate of the refrigerant decreases. Thus, in refrigeration cycle apparatus 100, the above-described occurrence of the abnormality is reduced or prevented even when compressor 11 is an inverter compressor, and thus, refrigeration cycle apparatus 100 is particularly suitable for a refrigeration cycle apparatus including an inverter compressor.

In addition, a plurality of branch pipes are disposed in the outdoor unit of the above-described conventional refrigeration cycle apparatus. For example, a branch pipe for connecting the four-way valve and the outdoor heat exchanger in parallel is disposed in the outdoor unit for each of two connection pipes that connect the outdoor unit and the branch unit to the outdoor heat exchanger. The branch pipe is provided to switch between a flow path through which the refrigerant flows during the cooling-only operation and during the cooling-dominated operation and a flow path through which the refrigerant flows during the heating-only operation and during the heating-dominated operation, and one check valve is disposed in each flow path. The gas single-phase refrigerant evaporated in the indoor heat exchanger during the heating-only operation and during the heating-dominated operation flows through one connection pipe into the outdoor unit, and flows through one of the two flow paths that branch off by the above-described branch pipe, and reaches the suction port of the compressor. A pressure loss also occurs when the gas single-phase refrigerant flows through the above-described branch pipe. In contrast, in refrigeration cycle apparatus 100, six-way valve 12 switches between the above-described first state and the above-described second state, and thus, the branch pipes and the check valves for performing the switching are unnecessary. As a result, in refrigeration cycle apparatus 100, a reduction in manufacturing cost and a reduction in pressure loss are simultaneously achieved, as compared with the above-described conventional refrigeration cycle apparatus.

As described above, in refrigeration cycle apparatus 100, a reduction in manufacturing cost, a reduction in pressure loss, a reduction in risk of the occurrence of poor connection between the brazed portions, and a reduction in size of outdoor unit 10 are simultaneously achieved, as compared with the above-described conventional refrigeration cycle apparatus. Furthermore, refrigeration cycle apparatus 100 is particularly suitable for a refrigeration cycle apparatus including an inverter compressor.

Second Embodiment

Figure 6:
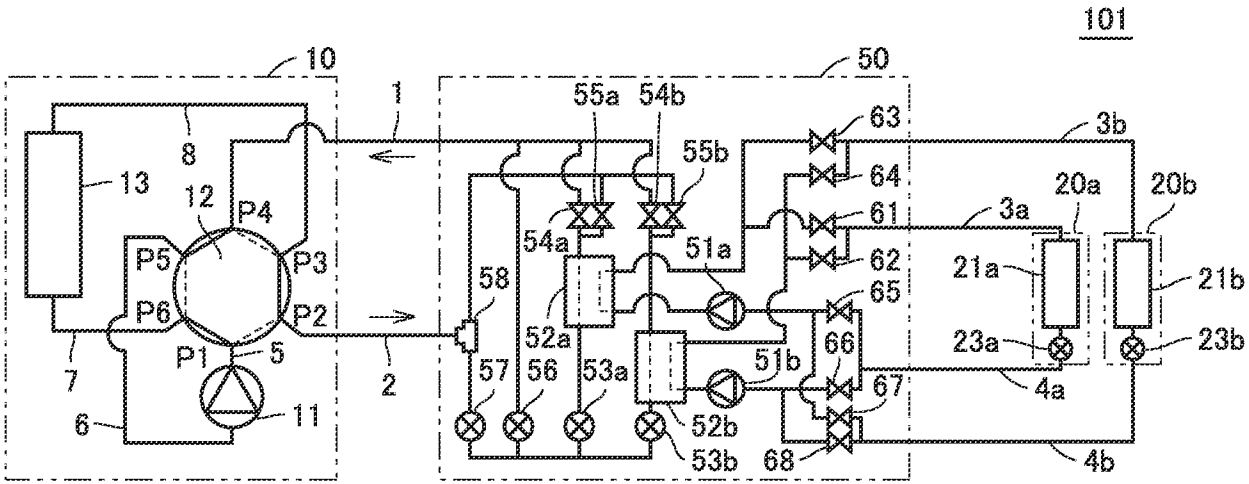
FIG. 6 shows a refrigeration cycle apparatus according to a second embodiment.

As shown in FIG. 6, a refrigeration cycle apparatus 101 according to a second embodiment is configured basically similarly to refrigeration cycle apparatus 100 according to the first embodiment. However, refrigeration cycle apparatus 101 according to the second embodiment is different from refrigeration cycle apparatus 100 according to the first embodiment in that refrigeration cycle apparatus 101 according to the second embodiment includes a refrigerant circuit in which refrigerant circulates and a heat medium circuit in which a heat medium circulates.

The refrigerant circuit includes compressor 11, six-way valve 12, first outdoor heat exchanger 13, a first branch unit heat exchanger 52*a* as a second heat exchanger, a second branch unit heat exchanger 52*b* as a third heat exchanger, a plurality of on-off valves Ma, 54*b*, 55*a*, and 55*b*, a fifth decompressing unit 53*a*, a sixth decompressing unit 53*b*, a seventh decompressing unit 56, and an eighth decompressing unit 57.

The heat medium circuit includes a first pump 51*a*, a second pump 51*b*, first branch unit heat exchanger 52*a*, second branch unit heat exchanger 52*b*, a plurality of on-off valves 61, 62, 63, 64, 65, 66, 67, and 68, first indoor heat exchanger 21*a*, second indoor heat exchanger 21*b*, a first flow rate control unit 23*a*, and a second flow rate control unit 23*b*.

The refrigerant is not particularly limited and may be, for example, fluorocarbon refrigerant suitable for a vapor compression-type refrigeration cycle. The heat medium is, for example, water or an antifreezing solution (such as, for example, propylene glycol or ethylene glycol).

Refrigeration cycle apparatus 101 includes outdoor unit 10, first indoor unit 20*a*, second indoor unit 20*b*, and a branch unit 50.

A first circuit portion of the above-described refrigerant circuit including compressor 11, six-way valve 12 and first outdoor heat exchanger 13 is disposed in outdoor unit 10. A fifth circuit portion of the above-described refrigerant circuit including first branch unit heat exchanger 52*a*, second branch unit heat exchanger 52*b*, the plurality of on-off valves 54*a*, 54*b*, 55*a*, and 55*b*, fifth decompressing unit 53*a*, sixth decompressing unit 53*b*, seventh decompressing unit 56, and eighth decompressing unit 57 is disposed in branch unit 50.

Furthermore, a first circuit portion of the heat medium circuit including first pump 51*a*, second pump 51*b*, first branch unit heat exchanger 52*a*, second branch unit heat exchanger 52*b*, and the plurality of on-off valves 61, 62, 63, 64, 65, 66, 67, and 68 is disposed in branch unit 50. A second circuit portion of the above-described heat medium circuit including first indoor heat exchanger 21*a* and first flow rate control unit 23*a* is disposed in first indoor unit 20*a*. A third circuit portion of the above-described heat medium circuit including second indoor heat exchanger 21*b* and second flow rate control unit 23*b* is disposed in second indoor unit 20*b*.

The above-described first circuit portion of the above-described refrigerant circuit disposed in outdoor unit 10 and the above-described fifth circuit portion of the above-described refrigerant circuit disposed in branch unit 50 are connected via first pipe 1 and second pipe 2. The above-described first circuit portion of the above-described heat medium circuit disposed in branch unit 50 and the above-described second circuit portion of the above-described heat medium circuit disposed in first indoor unit 20*a* are connected via third pipe 3*a* and fourth pipe 4*a*. The above-described first circuit portion of the above-described heat medium circuit disposed in branch unit 50 and the above-described third circuit portion of the above-described heat medium circuit disposed in second indoor unit 20*b* are connected via fifth pipe 3*b* and sixth pipe 4*b*. The second circuit portion and the third circuit portion of the above-described heat medium circuit are connected in parallel with the first circuit portion of the above-described heat medium circuit.

Outdoor unit 10 of refrigeration cycle apparatus 101 is configured similarly to outdoor unit 10 of refrigeration cycle apparatus 100. That is, six-way valve 12 of refrigeration cycle apparatus 101 is configured similarly to six-way valve 12 of refrigeration cycle apparatus 100 and can switch between the above-described first state and the above-described second state.

The fifth circuit portion of the above-described refrigerant circuit disposed in branch unit 50 further includes a branch pipe 58 configured similarly to branch pipe 33 in refrigeration cycle apparatus 100. Branch pipe 58 has a flow port connected to second pipe 2, a flow port disposed above the above-described flow port, and a flow port disposed below the above-described flow port.

An eleventh pipe connected to first pipe 1, a twelfth pipe connected to the flow port of branch pipe 58 disposed in the lower part, and thirteenth, fourteenth and fifteenth pipes that connect the eleventh pipe to the twelfth pipe and are disposed in parallel are disposed in the above-described fifth circuit portion. On-off valve Ma, first branch unit heat exchanger 52*a* and fifth decompressing unit 53*a* are included in the thirteenth pipe and disposed in this order from the first pipe 1 side. On-off valve 54*b*, second branch unit heat exchanger 52*b* and sixth decompressing unit 53*b* are included in the fourteenth pipe and disposed in this order from the first pipe 1 side. Seventh decompressing unit 56 is included in the fifteenth pipe. Eighth decompressing unit 57 is included in the twelfth pipe.

A sixteenth pipe connected to the flow port of branch pipe 58 disposed in the upper part, a seventeenth pipe that connects the sixteenth pipe to a portion of the thirteenth pipe located between on-off valve 54*a* and first branch unit heat exchanger 52*a*, and an eighteenth pipe that connects the sixteenth pipe to a portion of the fourteenth pipe located between on-off valve 54*b* and second branch unit heat exchanger 52*b* are further disposed in the above-described fifth circuit portion. On-off valve 55*a* is included in the seventeenth pipe. On-off valve 55*b* is included in the eighteenth pipe.

Twentieth and twenty-first pipes connected in parallel with the second circuit portion of the above-described heat medium circuit disposed in first indoor unit 20*a*, and twenty-second and twenty-third pipes connected in parallel with the third circuit portion of the above-described heat medium circuit disposed in second indoor unit 20*b* are disposed in the first circuit portion of the above-described heat medium circuit disposed in branch unit 50.

The above-described twentieth pipe and the above-described twenty-second pipe share a part thereof, and first pump 51*a* and first branch unit heat exchanger 52*a* are included in the part. The above-described twenty-first pipe and the above-described twenty-third pipe share a part thereof, and second pump 51*b* and second branch unit heat exchanger 52*b* are included in the part. On-off valves 61 and 65 are included in the above-described twentieth pipe. On-off valves 62 and 66 are included in the above-described twenty-first pipe. On-off valves 63 and 67 are included in the above-described twenty-second pipe. On-off valves 64 and 68 are included in the above-described twenty-third pipe.

From a different perspective, first indoor unit 20*a* and second indoor unit 20*b* are connected in parallel with first branch unit heat exchanger 52*a* in the above-described heat medium circuit. Furthermore, first indoor unit 20*a* and second indoor unit 20*b* are connected in parallel with second branch unit heat exchanger 52*b* in the above-described heat medium circuit.

First branch unit heat exchanger 52*a* and second branch unit heat exchanger 52*b* perform heat exchange between the refrigerant and the heat medium. First branch unit heat exchanger 52*a* is disposed on the outflow side of first pump 51*a* in the above-described twentieth pipe and the above-described twenty-second pipe. Second branch unit heat exchanger 52*b* is disposed on the outflow side of second pump 51*b* in the above-described twenty-first pipe and the above-described twenty-third pipe.

First flow rate control unit 23*a* controls a flow rate of the heat medium supplied to first indoor heat exchanger 21*a*. Second flow rate control unit 23*b* controls a flow rate of the heat medium supplied to second indoor heat exchanger 21*b*.

<Operation of Refrigeration Cycle Apparatus>

As described above, six-way valve 12 switches between the above-described first state and the above-described second state. Furthermore, when refrigeration cycle apparatus 101 is in the above-described first state, branch unit 50 switches between a seventh state in which first branch unit heat exchanger 52*a* and second branch unit heat exchanger 52*b* act as evaporators and an eighth state in which one of first branch unit heat exchanger 52*a* and second branch unit heat exchanger 52*b* acts as an evaporator and the other acts as a condenser. Furthermore, when refrigeration cycle apparatus 101 is in the above-described second state, branch unit 50 switches between a ninth state in which first branch unit heat exchanger 52*a* and second branch unit heat exchanger 52*b* act as condensers and a tenth state in which one of first branch unit heat exchanger 52*a* and second branch unit heat exchanger 52*b* acts as a condenser and the other acts as an evaporator.

The above-described seventh state is implemented during the cooling-only operation. The above-described eighth state is implemented during the cooling-dominated operation. The above-described ninth state is implemented during the heating-only operation. The above-described tenth state is implemented during the heating-dominated operation.

Refrigerant flow paths in outdoor unit 10 when refrigeration cycle apparatus 101 is in the above-described seventh state, the above-described eighth state, the above-described ninth state, and the above-described tenth state are similar to the refrigerant flow paths in outdoor unit 10 when refrigeration cycle apparatus 100 is in the above-described first state, the above-described second state, the above-described third state, and the above-described fourth state, respectively.

Therefore, refrigeration cycle apparatus 101 can provide an effect similar to that of refrigeration cycle apparatus 100.

Furthermore, the above-described refrigerant circuit of refrigeration cycle apparatus 101 is disposed only in outdoor unit 10, branch unit 50, first pipe 1, and second pipe 2, and is not disposed in first indoor unit 20*a* and second indoor unit 20*b*. Therefore, an amount of the refrigerant contained in the above-described refrigerant circuit of refrigeration cycle apparatus 101 can be smaller than an amount of the refrigerant contained in the above-described refrigerant circuit of refrigeration cycle apparatus 100. Furthermore, the risk of leakage of the refrigerant to the interior in refrigeration cycle apparatus 101 is significantly lower than the risk of leakage of the refrigerant to the interior in refrigeration cycle apparatus 100.

The above-described fifth circuit portion of the above-described refrigerant circuit of refrigeration cycle apparatus 101 disposed in branch unit 50 and the above-described heat medium circuit may be configured arbitrarily and are not limited to the above-described configuration. The above-described fifth circuit portion and the above-described heat medium circuit of refrigeration cycle apparatus 101 are configured similarly to those of a conventional refrigeration cycle apparatus including a refrigerant circuit and a heat medium circuit, for example.

<Modification>

Figure 7:
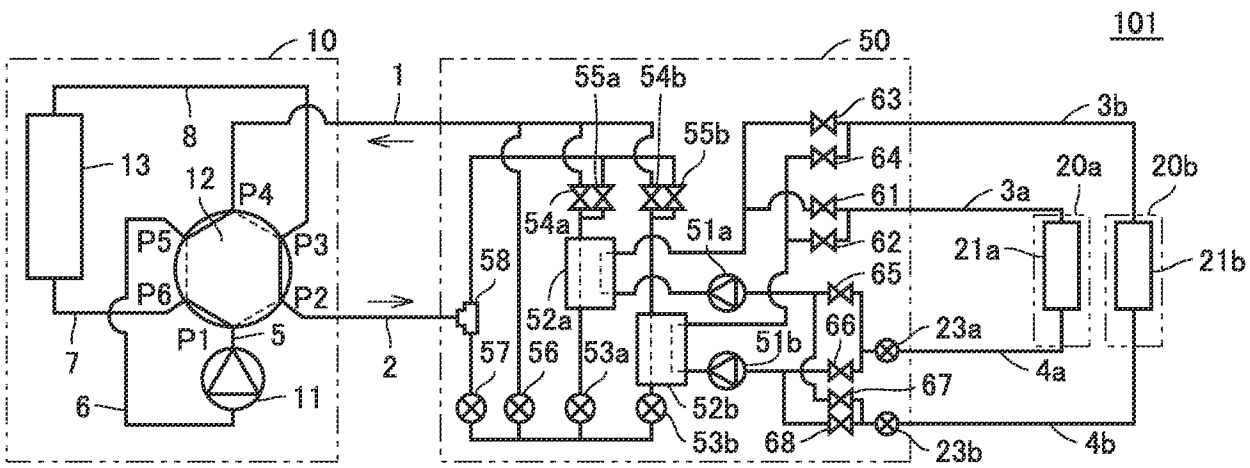
FIG. 7 shows a modification of the refrigeration cycle apparatus according to the second embodiment.
Figure 8:
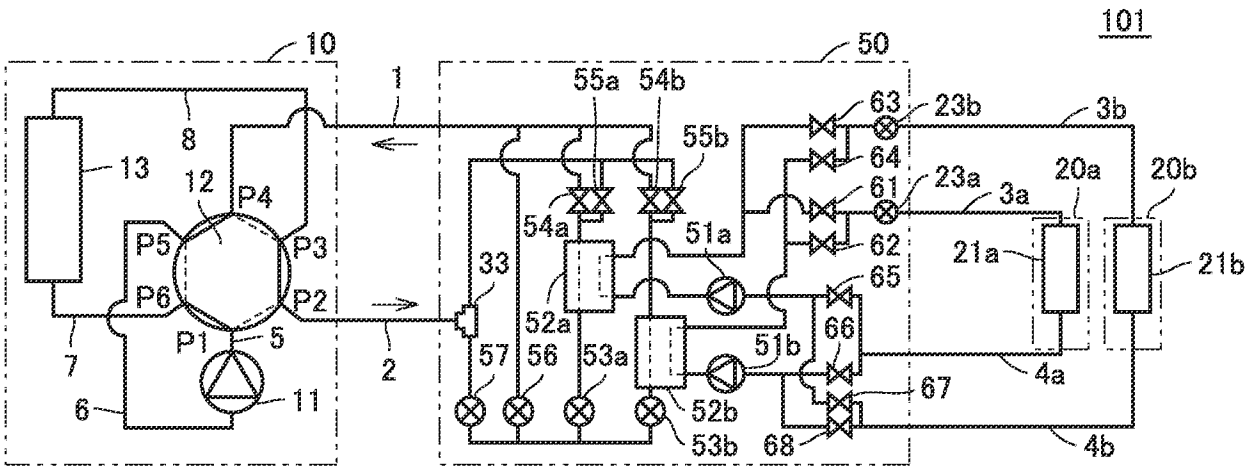
FIG. 8 shows another modification of the refrigeration cycle apparatus according to the second embodiment.

As shown in FIGS. 7 and 8, first flow rate control unit 23*a* and second flow rate control unit 23*b* may be disposed in branch unit 50.

As shown in FIG. 7, first flow rate control unit 23*a* may be disposed between fourth pipe 4*a* and on-off valves 65 and 66. Second flow rate control unit 23*b* may be disposed between sixth pipe 4*b* and on-off valves 67 and 68.

As shown in FIG. 8, first flow rate control unit 23*a* may be disposed between third pipe 3*a* and on-off valves 61 and 62. Second flow rate control unit 23*b* may be disposed between fifth pipe 3*b* and on-off valves 63 and 64.

Third Embodiment

Figure 9:
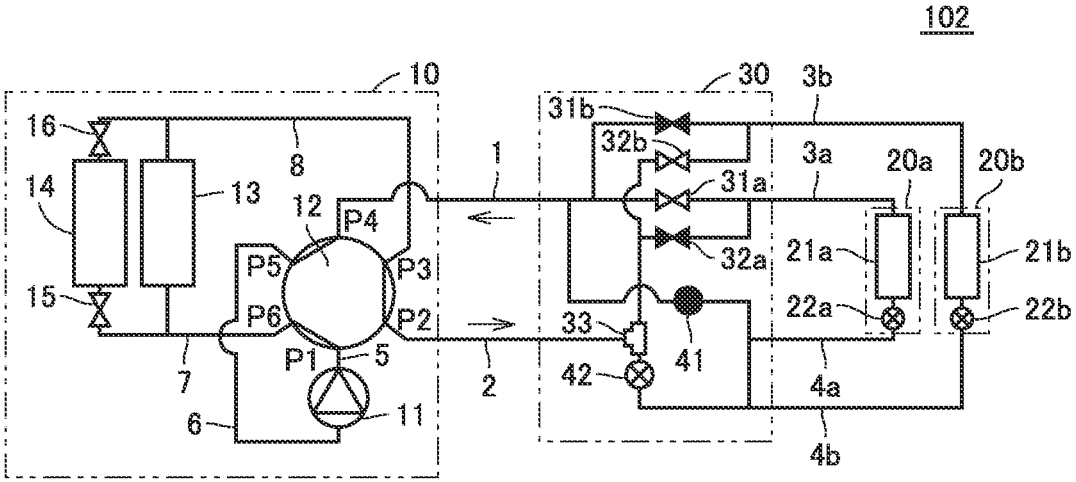
FIG. 9 shows a refrigerant circuit when a refrigeration cycle apparatus according to a third embodiment is performing the cooling-dominated operation.

As shown in FIG. 9, a refrigeration cycle apparatus 102 according to a third embodiment is configured basically similarly to refrigeration cycle apparatus 100 according to the first embodiment. However, refrigeration cycle apparatus 102 according to the third embodiment is different from refrigeration cycle apparatus 100 according to the first embodiment in that refrigeration cycle apparatus 102 according to the third embodiment further includes a second outdoor heat exchanger 14 as a fourth heat exchanger, and on-off valves 15 and 16. A refrigerant circuit of refrigeration cycle apparatus 102 is configured basically similarly to the above-described refrigerant circuit of refrigeration cycle apparatus 100. However, the refrigerant circuit of refrigeration cycle apparatus 102 is different from the above-described refrigerant circuit of refrigeration cycle apparatus 100 in that the refrigerant circuit of refrigeration cycle apparatus 102 further includes second outdoor heat exchanger 14 and on-off valves 15 and 16. FIG. 9 shows a refrigerant circuit when refrigeration cycle apparatus 102 is performing the cooling-dominated operation.

Second outdoor heat exchanger 14 and on-off valves 15 and 16 are disposed in outdoor unit 10. In the above-described refrigerant circuit, second outdoor heat exchanger 14 and on-off valves 15 and 16, and first outdoor heat exchanger 13 are connected in parallel between first flow pipe 7 and second flow pipe 8. On-off valve 15 is disposed between second outdoor heat exchanger 14 and first flow pipe 7. On-off valve 16 is disposed between second outdoor heat exchanger 14 and second flow pipe 8.

The operation for opening and closing on-off valves 15 and 16 is controlled in accordance with, for example, the outdoor air temperature. For example, when the outdoor air temperature becomes equal to or lower than a preset temperature, on-off valves 15 and 16 are closed.

Since refrigeration cycle apparatus 102 includes first outdoor heat exchanger 13 and second outdoor heat exchanger 14, a cooling and heating capacity when both of first outdoor heat exchanger 13 and second outdoor heat exchanger 14 act as condensers or evaporators is higher than a cooling and heating capacity of a refrigeration cycle apparatus including only one of first outdoor heat exchanger 13 and second outdoor heat exchanger 14.

Furthermore, in refrigeration cycle apparatus 102, an operation state in which second outdoor heat exchanger 14 is not used is implemented by closing on-off valves 15 and 16. For example, if first outdoor heat exchanger 13 and second outdoor heat exchanger 14 act as condensers when the outdoor air temperature is low during the cooling-dominated operation, a heat release capacity thereof becomes excessive, which leads to a reduction in condensation pressure. As a result, a saturation temperature of the gas-phase refrigerant supplied to the indoor heat exchangers that are performing the heating operation decreases, and thus, a requested heating capacity is not obtained. In such a case, in refrigeration cycle apparatus 102, the heat release capacity of the condensers can be reduced by closing on-off valves 15 and 16, and thus, the reduction in condensation pressure is suppressed. As a result, in refrigeration cycle apparatus 102, the requested heating capacity can be obtained even in the above-described case.

Fourth Embodiment

Figure 10:
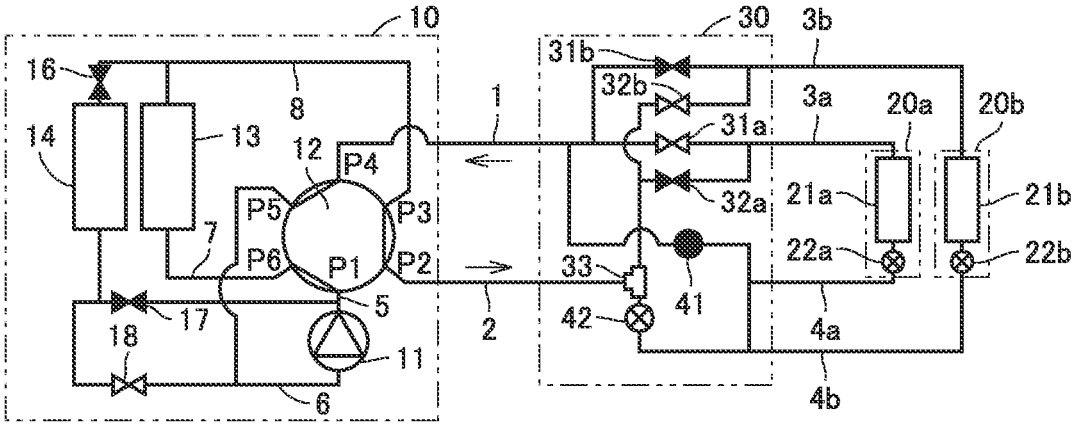
FIG. 10 shows a refrigerant circuit when a refrigeration cycle apparatus according to a fourth embodiment is performing the cooling-dominated operation.

As shown in FIG. 10, a refrigeration cycle apparatus 103 according to a fourth embodiment is configured basically similarly to refrigeration cycle apparatus 100 according to the first embodiment. However, refrigeration cycle apparatus 103 according to the fourth embodiment is different from refrigeration cycle apparatus 100 according to the first embodiment in that refrigeration cycle apparatus 103 according to the fourth embodiment further includes second outdoor heat exchanger 14 and on-off valves 16, 17 and 18. A refrigerant circuit of refrigeration cycle apparatus 103 is configured basically similarly to the above-described refrigerant circuit of refrigeration cycle apparatus 100. However, the refrigerant circuit of refrigeration cycle apparatus 103 is different from the above-described refrigerant circuit of refrigeration cycle apparatus 100 in that the refrigerant circuit of refrigeration cycle apparatus 103 further includes second outdoor heat exchanger 14 and on-off valves 16, 17 and 18. FIG. 10 shows a refrigerant circuit when refrigeration cycle apparatus 103 is performing the cooling-dominated operation and second outdoor heat exchanger 14 does not act as a condenser.

Second outdoor heat exchanger 14 and on-off valves 16, 17 and 18 are disposed in outdoor unit 10. In the above-described refrigerant circuit, second outdoor heat exchanger 14 and on-off valves 16 and 17, and first outdoor heat exchanger 13 are connected in parallel between discharge pipe 5 and second flow pipe 8. On-off valve 16 is disposed between second outdoor heat exchanger 14 and second flow pipe 8. On-off valve 17 is disposed between second outdoor heat exchanger 14 and discharge pipe 5. On-off valve 18 is disposed between second outdoor heat exchanger 14 and suction pipe 6.

In the above-described first state and the above-described second state, on-off valve 16 is opened when first outdoor heat exchanger 13 and second outdoor heat exchanger 14 are used, and is closed when second outdoor heat exchanger 14 is not used.

In the above-described first state, on-off valve 17 is opened when first outdoor heat exchanger 13 and second outdoor heat exchanger 14 are used, and is closed when second outdoor heat exchanger 14 is not used. In the above-described second state, on-off valve 17 is closed. In the above-described first state, the operation for opening and closing on-off valves 16 and 17 is controlled in accordance with, for example, the outdoor air temperature. For example, when the outdoor air temperature becomes equal to or higher than a preset temperature, on-off valves 16 and 17 are closed.

In the above-described first state, on-off valve 18 is closed when first outdoor heat exchanger 13 and second outdoor heat exchanger 14 are used, and is opened when second outdoor heat exchanger 14 is not used. In the above-described second state, on-off valve 18 is opened when first outdoor heat exchanger 13 and second outdoor heat exchanger 14 are used, and is closed when second outdoor heat exchanger 14 is not used.

Since refrigeration cycle apparatus 103 includes first outdoor heat exchanger 13 and second outdoor heat exchanger 14, a cooling and heating capacity when both of first outdoor heat exchanger 13 and second outdoor heat exchanger 14 act as condensers or evaporators is higher than a cooling and heating capacity of a refrigeration cycle apparatus including only one of first outdoor heat exchanger 13 and second outdoor heat exchanger 14.

Furthermore, in refrigeration cycle apparatus 103, an operation state in which second outdoor heat exchanger 14 is not used is implemented by closing on-off valves 16 and 17 as shown in FIG. 10. Such an operation state is implemented, for example, when the outdoor air temperature is low during the cooling-dominated operation. If first outdoor heat exchanger 13 and second outdoor heat exchanger 14 act as condensers when the outdoor air temperature is low during the cooling-dominated operation, a heat release capacity thereof becomes excessive, which leads to a reduction in condensation pressure. As a result, a saturation temperature of the gas-phase refrigerant supplied to the indoor heat exchangers that are performing the heating operation decreases, and thus, a requested heating capacity is not obtained. In such a case, in refrigeration cycle apparatus 103, the heat release capacity of the condensers can be reduced by closing on-off valves 16 and 17, and thus, the reduction in condensation pressure is suppressed. As a result, in refrigeration cycle apparatus 103, the requested heating capacity can be obtained even in the above-described case.

In addition, as shown in FIG. 10, on-off valve 18 is preferably opened during an operation state in which second outdoor heat exchanger 14 is not used. With this, even when a closing capacity of on-off valve 16 or on-off valve 17 is insufficient and the refrigerant flows into second outdoor heat exchanger 14, the refrigerant flowing into second outdoor heat exchanger 14 is sucked into compressor 11, and thus, accumulation in second outdoor heat exchanger 14 can be prevented.

Fifth Embodiment

Figure 11:
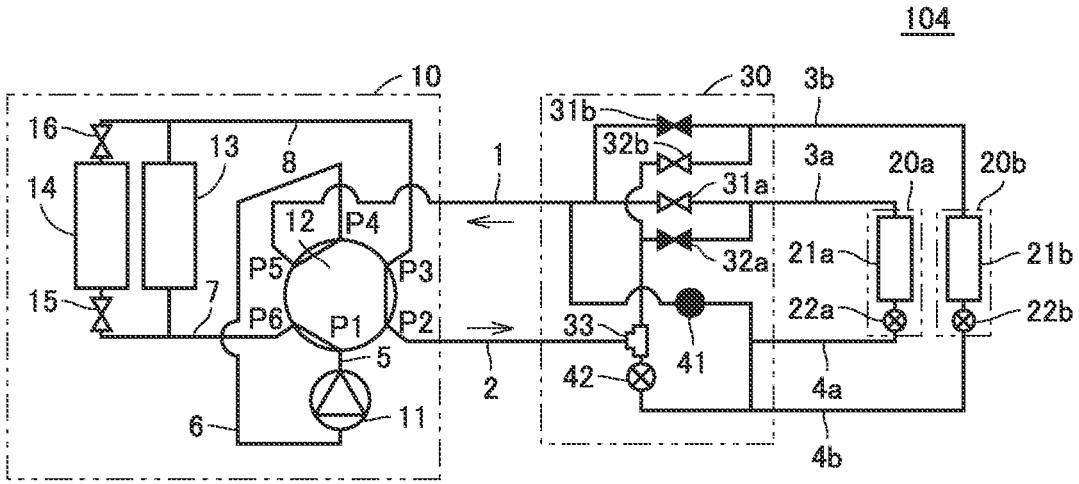
FIG. 11 shows a refrigerant circuit when a refrigeration cycle apparatus according to a fifth embodiment is performing the cooling-dominated operation.
Figure 12:
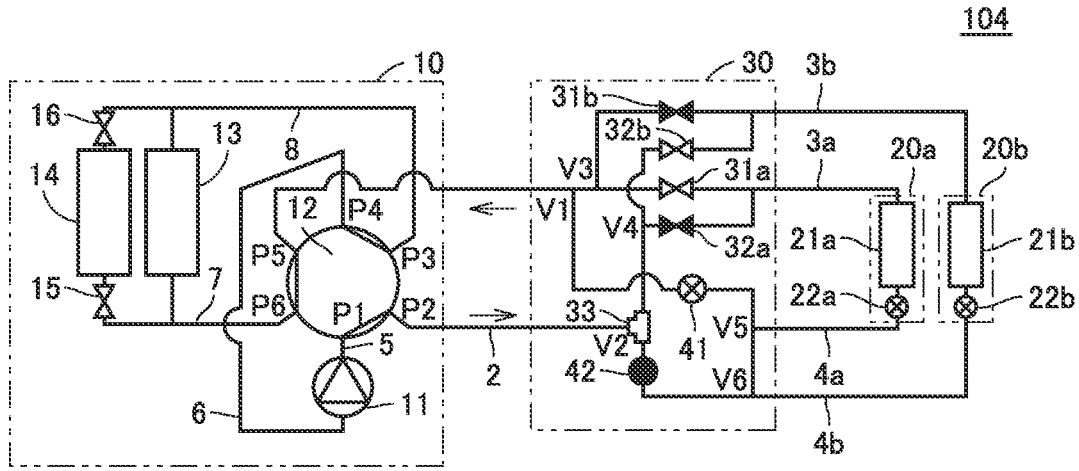
FIG. 12 shows a refrigerant circuit when the refrigeration cycle apparatus according to the fifth embodiment is performing the heating-dominated operation.

As shown in FIGS. 11 and 12, a refrigeration cycle apparatus 104 according to a fifth embodiment is configured basically similarly to refrigeration cycle apparatus 102 according to the third embodiment. However, refrigeration cycle apparatus 104 according to the fifth embodiment is different from refrigeration cycle apparatus 102 according to the third embodiment in that fourth opening P4 is connected to the suction port of compressor 11 via suction pipe 6 and fifth opening P5 is connected to first pipe 1. FIG. 11 shows a refrigerant circuit when refrigeration cycle apparatus 104 is performing the cooling-dominated operation. FIG. 12 shows a refrigerant circuit when refrigeration cycle apparatus 104 is performing the heating-dominated operation.

As shown in FIGS. 11 and 12, in either of the above-described first state and the above-described second state, first flow pipe 7 of refrigeration cycle apparatus 104 is disposed upstream of first outdoor heat exchanger 13 and second outdoor heat exchanger 14. In either of the above-described first state and the above-described second state, second flow pipe 8 of refrigeration cycle apparatus 104 is disposed downstream of first outdoor heat exchanger 13 and second outdoor heat exchanger 14. Therefore, in refrigeration cycle apparatus 104, a flow direction of the refrigerant flowing through first outdoor heat exchanger 13 and second outdoor heat exchanger 14 is fixed in either of the above-described first state and the above-described second state.

As a result, in either of the above-described first state and the above-described second state, on-off valve 15 is disposed upstream of second outdoor heat exchanger 14. In either of the above-described first state and the above-described second state, on-off valve 16 is disposed downstream of second outdoor heat exchanger 14.

In the above-described first state and the above-described second state, on-off valve 15 is opened when first outdoor heat exchanger 13 and second outdoor heat exchanger 14 are used, and is closed when second outdoor heat exchanger 14 is not used. The operation for opening and closing on-off valve 15 is controlled in accordance with, for example, the outdoor air temperature and the like. In contrast, although on-off valve 16 may be configured similarly to on-off valve 15, on-off valve 16 may only be provided to prevent at least an inflow of the refrigerant from second flow pipe 8 to second outdoor heat exchanger 14. On-off valve 16 may be implemented by, for example, a check valve. When on-off valve 16 is implemented by a check valve, on-off valve 16 can be reduced in size and the manufacturing cost of refrigeration cycle apparatus 104 can be reduced, as compared with when on-off valve 16 is implemented by a solenoid valve or the like.

Although refrigeration cycle apparatuses 102 to 104 according to the third to fifth embodiments shown in FIGS. 9 to 11 include first indoor unit 20*a*, second indoor unit 20*b* and branch unit 30 configured similarly to those of refrigeration cycle apparatus 100 according to the first embodiment, refrigeration cycle apparatuses 102 to 104 according to the third to fifth embodiments shown in FIGS. 9 to 11 may include first indoor unit 20*a*, second indoor unit 20*b* and branch unit 50 configured similarly to those of refrigeration cycle apparatus 101 according to the second embodiment.

In addition, although refrigeration cycle apparatus 104 according to the fifth embodiment shown in FIG. 11 includes second outdoor heat exchanger 14 and on-off valves 15 and 16 configured similarly to those of refrigeration cycle apparatus 102 according to the third embodiment, refrigeration cycle apparatus 104 according to the fifth embodiment shown in FIG. 11 may include second outdoor heat exchanger 14 and on-off valves 16, 17 and 18 configured similarly to those of refrigeration cycle apparatus 103 according to the fourth embodiment.

In addition, each of a pair of on-off valves 17 and 18, a pair of on-off valves 31*a* and 31*b*, a pair of on-off valves 32*a* and 32*b*, a pair of on-off valves 54*a* and 55*a*, a pair of on-off valves 54*b* and 55*b*, a pair of on-off valves 61 and 62, a pair of on-off valves 63 and 64, a pair of on-off valves 65 and 66, and a pair of on-off valves 67 and 68 described above may be implemented as, for example, a three-way valve.

While the embodiments of the present invention have been described above, the above-described embodiments can also be modified variously. In addition, the scope of the present invention is not limited to the above-described embodiments. The scope of the present invention is defined by the terms of the claims, and is intended to include any modifications within the scope and meaning equivalent to the terms of the claims.

The invention claimed is:

1. A refrigeration cycle apparatus having a refrigerant circuit in which refrigerant circulates, the refrigeration cycle apparatus comprising:

an outdoor unit;

a branch unit connected to the outdoor unit via a first pipe and a second pipe;

a first indoor unit connected to the branch unit via a third pipe and a fourth pipe; and a second indoor unit connected to the branch unit via a fifth pipe and a sixth pipe, the refrigerant circuit including a compressor, a first heat exchanger, a second heat exchanger, a third heat exchanger, and a six-way valve, the compressor, the first heat exchanger and the six-way valve being located in the outdoor unit, the second heat exchanger being disposed in the branch unit, the third heat exchanger being disposed in the branch unit, the first heat exchanger having a first flow port and a second flow port through which the refrigerant flows in and out in the refrigerant circuit, the six-way valve switching between a first state in which the first heat exchanger acts as a condenser and at least the second heat exchanger acts as an evaporator and a second state in which the first heat exchanger acts as an evaporator and at least the second heat exchanger acts as a condenser, in the first state, the six-way valve having a first flow path connecting a discharge port of the compressor to the first flow port of the first heat exchanger, a second flow path connecting the second flow port of the first heat exchanger to the second pipe, and a third flow path connecting the first pipe to a suction port of the compressor, in the second state, the six-way valve having a fourth flow path connecting the discharge port of the compressor to the second pipe, a fifth flow path connecting the first pipe to the second flow port of the first heat exchanger, and a sixth flow path connecting the first flow port of the first heat exchanger to the suction port of the compressor, the refrigeration cycle apparatus further comprising a heat medium circuit in which a heat medium circulates, wherein in the second heat exchanger and the third heat exchanger, heat exchange is performed between the refrigerant circulating in the refrigerant circuit and the heat medium circulating in the heat medium circuit, in the first state, the branch unit switches between a seventh state in which the second heat exchanger and the third heat exchanger act as evaporators and an eighth state in which one of the second heat exchanger and the third heat exchanger acts as an evaporator and the other acts as a condenser, and in the second state, the branch unit switches between a ninth state in which the second heat exchanger and the third heat exchanger act as condensers and a tenth state in which one of the second heat exchanger and the third heat exchanger acts as a condenser and the other acts as an evaporator.

2. The refrigeration cycle apparatus according to claim 1, wherein the six-way valve has a first opening, a second opening, a third opening, a fourth opening, a fifth opening, and a sixth opening, in the first state, the first flow path is disposed between the first opening and the sixth opening, the second flow path is disposed between the third opening and the second opening, and the third flow path is disposed between the fifth opening and the fourth opening, in the second state, the fourth flow path is disposed between the first opening and the second opening, the fifth flow path is disposed between the fifth opening and the sixth opening, and the sixth flow path is disposed between the third opening and the fourth opening, the first opening is connected to the discharge port of the compressor, the second opening is connected to the second pipe, the third opening is connected to the second flow port of the first heat exchanger, the sixth opening is connected to the first flow port of the first heat exchanger, the fourth opening is connected to the suction port of the compressor, and the fifth opening is connected to the first pipe.

3. The refrigeration cycle apparatus according to claim 1, wherein the refrigerant circuit further includes a first on-off valve, a fourth heat exchanger and a second on-off valve, the first on-off valve, the fourth heat exchanger and the second on-off valve are connected in series to each other and connected in parallel with the first heat exchanger, the fourth heat exchanger has a third flow port and a fourth flow port through which the refrigerant flows in and out in the refrigerant circuit, the first on-off valve is disposed between the discharge port of the compressor and the third flow port of the fourth heat exchanger, and the second on-off valve is disposed between the fourth flow port of the fourth heat exchanger and the second pipe in the first state, and is disposed between the fourth flow port of the fourth heat exchanger and the suction port of the compressor in the second state.

4. The refrigeration cycle apparatus according to claim 3, wherein the refrigerant circuit further includes a third on-off valve, the third on-off valve is disposed between the suction port of the compressor and the third flow port of the fourth heat exchanger, and in the first state and the second state, the third on-off valve is opened when the first on-off valve and the second on-off valve are closed.

5. A refrigeration cycle apparatus having a refrigerant circuit in which refrigerant circulates, the refrigeration cycle apparatus comprising:

an outdoor unit;

a branch unit connected to the outdoor unit via a first pipe and a second pipe;

a first indoor unit connected to the branch unit via a third pipe and a fourth pipe; and a second indoor unit connected to the branch unit via a fifth pipe and a sixth pipe, the refrigerant circuit including a compressor, a first heat exchanger, a second heat exchanger, a third heat exchanger, and a six-way valve, the compressor, the first heat exchanger and the six-way valve being located in the outdoor unit, the second heat exchanger being disposed in the first indoor unit, the third heat exchanger being disposed in the second indoor unit, the first heat exchanger having a first flow port and a second flow port through which the refrigerant flows in and out in the refrigerant circuit, the six-way valve switching between a first state in which the first heat exchanger acts as a condenser and at least the second heat exchanger acts as an evaporator and a second state in which the first heat exchanger acts as an evaporator and at least the second heat exchanger acts as a condenser, in the first state, the six-way valve having a first flow path connecting a discharge port of the compressor to the first flow port of the first heat exchanger, a second flow path connecting the second flow port of the first heat exchanger to the second pipe, and a third flow path connecting the first pipe to a suction port of the compressor, in the second state, the six-way valve having a fourth flow path connecting the discharge port of the compressor to the second pipe, a fifth flow path connecting the first pipe to the second flow port of the first heat exchanger, and a sixth flow path connecting the first flow port of the first heat exchanger to the suction port of the compressor, wherein in the first state, the branch unit switches between a third state in which the second heat exchanger and the third heat exchanger act as evaporators and a fourth state in which one of the second heat exchanger and the third heat exchanger acts as an evaporator and the other acts as a condenser, and in the second state, the branch unit switches between a fifth state in which the second heat exchanger and the third heat exchanger act as condensers and a sixth state in which one of the second heat exchanger and the third heat exchanger acts as a condenser and the other acts as an evaporator.

6. The refrigeration cycle apparatus according to claim 5, wherein the refrigerant circuit further includes a first on-off valve, a fourth heat exchanger and a second on-off valve, the first on-off valve, the fourth heat exchanger and the second on-off valve are connected in series to each other and connected in parallel with the first heat exchanger, the fourth heat exchanger has a third flow port and a fourth flow port through which the refrigerant flows in and out in the refrigerant circuit, the first on-off valve is disposed between the discharge port of the compressor and the third flow port of the fourth heat exchanger, and the second on-off valve is disposed between the fourth flow port of the fourth heat exchanger and the second pipe in the first state, and is disposed between the fourth flow port of the fourth heat exchanger and the suction port of the compressor in the second state.

7. The refrigeration cycle apparatus according to claim 6, wherein the refrigerant circuit further includes a third on-off valve, the third on-off valve is disposed between the suction port of the compressor and the third flow port of the fourth heat exchanger, and in the first state and the second state, the third on-off valve is opened when the first on-off valve and the second on-off valve are closed.

8. The refrigeration cycle apparatus according to claim 2, wherein the refrigerant circuit further includes a first on-off valve, a fourth heat exchanger and a second on-off valve, the first on-off valve, the fourth heat exchanger and the second on-off valve are connected in series to each other and connected in parallel with the first heat exchanger, the fourth heat exchanger has a third flow port and a fourth flow port through which the refrigerant flows in and out in the refrigerant circuit, the first on-off valve is disposed between the discharge port of the compressor and the third flow port of the fourth heat exchanger, and the second on-off valve is disposed between the fourth flow port of the fourth heat exchanger and the second pipe in the first state, and is disposed between the fourth flow port of the fourth heat exchanger and the suction port of the compressor in the second state.

9. The refrigeration cycle apparatus according to claim 8, wherein the refrigerant circuit further includes a third on-off valve, the third on-off valve is disposed between the suction port of the compressor and the third flow port of the fourth heat exchanger, and in the first state and the second state, the third on-off valve is opened when the first on-off valve and the second on-off valve are closed.

10. The refrigeration cycle apparatus according to claim 5, wherein the six-way valve has a first opening, a second opening, a third opening, a fourth opening, a fifth opening, and a sixth opening, in the first state, the first flow path is disposed between the first opening and the sixth opening, the second flow path is disposed between the third opening and the second opening, and the third flow path is disposed between the fifth opening and the fourth opening, in the second state, the fourth flow path is disposed between the first opening and the second opening, the fifth flow path is disposed between the fifth opening and the sixth opening, and the sixth flow path is disposed between the third opening and the fourth opening, the first opening is connected to the discharge port of the compressor, the second opening is connected to the second pipe, the third opening is connected to the second flow port of the first heat exchanger, the sixth opening is connected to the first flow port of the first heat exchanger, the fourth opening is connected to the suction port of the compressor, and the fifth opening is connected to the first pipe.

11. The refrigeration cycle apparatus according to claim 10, wherein the refrigerant circuit further includes a first on-off valve, a fourth heat exchanger and a second on-off valve, the first on-off valve, the fourth heat exchanger and the second on-off valve are connected in series to each other and connected in parallel with the first heat exchanger, the fourth heat exchanger has a third flow port and a fourth flow port through which the refrigerant flows in and out in the refrigerant circuit, the first on-off valve is disposed between the discharge port of the compressor and the third flow port of the fourth heat exchanger, and the second on-off valve is disposed between the fourth flow port of the fourth heat exchanger and the second pipe in the first state, and is disposed between the fourth flow port of the fourth heat exchanger and the suction port of the compressor in the second state.

12. The refrigeration cycle apparatus according to claim 11, wherein the refrigerant circuit further includes a third on-off valve, the third on-off valve is disposed between the suction port of the compressor and the third flow port of the fourth heat exchanger, and in the first state and the second state, the third on-off valve is opened when the first on-off valve and the second on-off valve are closed.

* * * * *